United States Patent [19]

Walther

[11] Patent Number: 4,606,339

[45] Date of Patent: Aug. 19, 1986

[54] CONTROL VALVE FOR A BREATHING MASK

[75] Inventor: Hans-Joachim Walther, Lubeck, Fed. Rep. of Germany

[73] Assignee: Drägerwerk AG, Fed. Rep. of Germany

[21] Appl. No.: 691,446

[22] Filed: Jan. 14, 1985

[30] Foreign Application Priority Data

Jan. 17, 1984 [DE] Fed. Rep. of Germany ..... 3401383

[51] Int. Cl.[4] ..... A62B 7/04

[52] U.S. Cl. ..... 128/204.19; 128/204.26; 137/495; 251/65

[58] Field of Search ..... 128/204.19, 204.26, 128/205.24; 137/495, 505.38, 505.39, 505.42, 505.46; 251/65

[56] References Cited

U.S. PATENT DOCUMENTS

| | | | |
|---|---|---|---|
| 2,764,996 | 10/1956 | Brown | 137/505.42 |
| 2,765,802 | 10/1956 | Powell | 251/65 |
| 2,972,465 | 2/1961 | Ray | 251/65 |
| 3,121,552 | 2/1964 | Wilson | 251/65 |
| 3,212,751 | 10/1965 | Hassa | 251/65 |
| 3,561,466 | 2/1971 | Carden | 251/65 |
| 3,610,237 | 10/1971 | Barkalow et al. | 128/204.19 |
| 4,273,153 | 6/1981 | Brown | 251/65 |

FOREIGN PATENT DOCUMENTS

| | | | |
|---|---|---|---|
| 2620170 | 11/1977 | Fed. Rep. of Germany | 128/204.26 |

*Primary Examiner*—Henry J. Recla
*Attorney, Agent, or Firm*—McGlew and Tuttle

[57] ABSTRACT

The use of respirator masks with positive pressure in the interior of the mask makes sure that during inhalation as well as exhalation a positive pressure prevails which prevents ambient atmosphere from entering. The lung controlled valve is separated by a control membrane into a breathing chamber and an outer chamber. The breathing gas chamber, connected with the interior of the mask, has the internal pressure thereof. For respiratory gas supply, the breathing gas chamber is connected with the respiratory gas source through an inlet valve controlled by the control membrane via a coupling means. The outer chamber contains a shutoff device by which the control membrane, manually actuated by a magnetic key, is held in a shutting position with simultaneous closing of the inlet valve. With the respirator mask taken off, unnecessary flow of respiratory gas is prevented. Upon placing it on and starting to breathe, the control member is pulled off the magnet without any additional action to be undertaken by the user, being thereby released from the shutting position. Normal lung controlled respiratory gas supply with the positive pressure in the interior of the mask is again possible.

5 Claims, 2 Drawing Figures

CONTROL VALVE FOR A BREATHING MASK

FIELD AND BACKGROUND OF THE INVENTION

This invention relates in general to respirators and in particular to a new and useful respirator mask control valve.

Such a respirator mask with positive pressure in the interior of the mask is already known from German Patent application No. P 32 45 717.

In compressed gas respirators with positive pressure in the mask it is ensured that a positive pressure prevails in the mask during use both in the exhaling and in the inhaling phase. This positive pressure prevents, under all circumstances, possibly harmful ambient atmosphere from getting into the mask during use. In them, gas can flow only from the interior outwardly if leaks develop. In these respirators, however, the difficulties must be overcome which result from the fact that when use is ended and the mask is taken off, that is, with the opening of the respiratory cycle, the respiratory gas reservoirs must be closed or the operation of the lung motor switched, to avoid discharge of respiratory gas and hence shortening of the utilization time.

From German OS No. 30 38 100 equipping a respirator mask with a lung controlled valve is known with which a positive pressure is created and maintained in the interior of the mask. The valve comprises in a valve housing, between a breathing chamber discharging before the respiratory organs of the user and an outer chamber connected with the outside atmosphere, a pressure chamber connected with both chambers through a valve for each. With this pressure chamber a positive pressure is created in the breathing chamber and hence in the interior of the mask both during inhalation and during exhalation. To this end, a wall portion of the pressure chamber is movably connected with the inner wall of the valve housing via a control membrane. A respiratory gas inlet valve of the mask is actuated through an actuating device by way of the breathing pressure movement of the pressure chamber.

A switchable shutting device makes it possible to interrupt the respiratory gas supply when the mask is taken off. The shutting device consists of a shaft rotatably mounted in the breathing chamber. One end is passed in an airtight guide bushing through the wall of the breathing chamber to the outside and is provided there with a radial actuating lever. At the lever the shaft can be turned between two end positions. In one end position, the shutting position, an elastic tongue of the actuating lever snaps into a recess in the wall of the breathing chamber. In the shutting position the wire strap touches the lever arm of the inlet valve and brings it into the closing position. A thigh spring pushes the wire strap, which turns with the shaft, into the other end position, the release position, in which it abuts against the inner wall of the breathing chamber and permits free movement of the lever arm. With the mask taken off, the previously actuable actuating lever has been engaged into the shutting position, thereby interrupting the respiratory gas supply. After the mask has been placed on, the first breath causes automatic switching on. With the inhalation suction acting on the membrane a force sufficient to push the shutting device out of the locking engagement of the shutting position must be produced at the lever arm. The thigh spring then brings the shutting device into the release position.

Since, however, the turn-on force depends on the locking of the shutting device present on the outer side, it is possible that in the course of use dirt, the use of force, or wear will cause changes which will affect the switch-on resistance and reliability. Proper sealing of the lead-through through the wall of the breathing chamber is expensive and a possible source of malfunction, as is also the construction of the shutting device from a plurality of separate parts.

Further, German patent application No. P 32 45 717 another respirator mask with positive pressure in the interior of the mask is known which also is created and maintained by a lung controlled valve. The housing of the lung controlled valve with a respiratory gas feed connection and with a discharge connection for the respiratory gas to the mask is closed off with a cover. The housing is separated by a control membrane, forming an outer chamber toward the cover and a breathing chamber therebelow. The breathing chamber is connected with the interior of the mask through the discharge connection. The respiratory gas connection is switchable with the breathing chamber through an inlet valve which is in contact with the control membrane via a lever means.

The outer chamber contains a control means with which, manually released by a shutoff valve to be displaced laterally, the control membrane is held in a shutting position relieved of pressure, through a holding collar with a simultaneous closing of the inlet valve. Upon inhalation, the pressure in the mask and in the breathing chamber decreases. Thereby, under the force of a spring, a positive pressure lever displaces the inlet valve into open position via the control membrane and the lever means. If removal of the mask, and hence also the absence of positive pressure outflow of respiratory gas, is to be prevented, the shutoff valve, now in the shutting position, lifts the pressure lever off the control membrane, which then rises, relieved of pressure, under the action of the closing spring of the valve, which closes. Its holding collar is wedged in after the shutoff valve has been released. The inlet valve remains closed to the next deep breath after the mask has been placed on.

It is the object of the invention to improve a respirator mask with positive pressure in the interior of the mask, in such a way that with the elimination of mechanical parts from the lung controlled valve, wear and possible wedging of a lever mechanism can no longer be a cause of failure.

In accordance with the invention the respirator mask operates with a positive pressure at its interior and for this purpose it has a lung controlled valve having a housing with a breathing gas chamber which discharges before the user's respiratory organs which is connected to a respiratory gas supply through a valve which is regulated by a diaphragm separating the housing and the breathing gas chamber from an outer chamber to regulate the supply of the breathing gas to the mask through the breathing gas chamber. With the invention, a key is mounted on the housing and is movable relative thereto against the force of a return spring and it has an inner end which is magnetically engageable with the diaphragm so as to hold it so that it closes the valve from the breathing gas supply so that there is no outflow of respiratory gas when the mask is removed. The arrangement is such that when the mask is used the key becomes automatically disengaged. The inlet valve with remain closed until the next breath by the user in which case the key will become released from the diaphragm.

An advantage achieved with the invention in particular is that, instead of a plurality of parts which must move together, practically only the magnetic key opposite a steel plate in the control membrane causes the shutting of the inlet valve in any case. The magnetic forces are controllable with certainty and there can be no wear.

Accordingly, it is an object of the invention to provide an improved breathing gas control valve whose housing contains between a breathing chamber discharging for the user's respiratory organs and an outer chamber connected with the outside atmosphere provided with a shutoff means, a control membrane with which an inlet valve for the respiratory gas can be actuated via coupling means and wherein the shutoff means is a magnetic key guided in a housing cover and held externally by a return spring and which carries a magnet at its inner end opposite a steel plate carried on a control membrane which separates the chamber of the valve into an outer chamber and a breathing gas chamber in an arrangement wherein the control diaphragm is connected with the inlet valve via a coupling controlled by a positive pressure spring as a function of the inside pressure of the mask and wherein the pressed in magnetic key keeps the inlet valve closed via the magnetically adhering steel plate.

A further object of the invention is to provide a breathing gas control valve for a breathing mask in which means are provided to ensure the closeoff of the breathing gas when the mask is not used and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
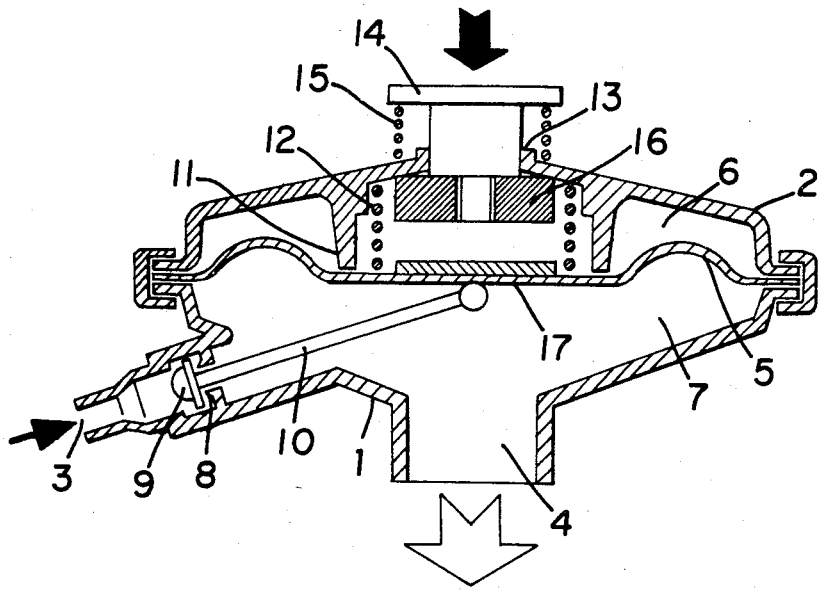
FIG. 1 is a sectional view of a lung controlled valve in normal operating position constructed in accordance with the invention.

Referring to the drawings in particular the invention embodied therein comprises a breathing gas control valve for a breathing mask and which includes a housing 1 having an interior chamber with a diaphragm 5 extending across the chamber and dividing it into an outer chamber 6 on one side of the diaphragm and a breathing gas chamber 7 on the other. A respiratory gas inlet 3 is connected into the chamber 7 and a discharge 4 is connected from the chamber 7 to the mask. A valve body 9 closes a valve 8 to shut off the respiratory gas inlet supply 3. Coupling means in the form of a coupling rod 10 connects the valve body 9 to the diaphragm 5.

In accordance with the invention a key 14 is movably mounted in the housing 1 and has an end facing the diaphragm. The end facing the diaphragm and the diaphragm have magnetically attractable portions which permit magnetic interengagement of the key with the diaphragm to hold the diaphragm in a position in which the valve body closes the valve inlet 8. Spring means including a return spring 15 acting on the magnetic key 14 and a pressure spring 12 act on the magnetic key 14 and the diaphragm 5 to bias them into a separated position. The arrangement is such that the key 14 and the diaphragm 5 are interengageable together in an attracted position to hold the valve body 9 against the valve inlet seat 8 to stop the flow of respiratory gas. The key 14 is depressed so as to cause this magnetic attraction when the mask is not being used.

The lung controlled valve connected ahead of the respirator mask has a housing 1 with a respiratory gas inlet connection 3 and a discharge connection 4 to the mask and is closed off by a cover 2. The valve housing 1 is separated toward the cover 2 by a control membrane or diaphragm 5, forming above the diaphragm an outer chamber 6 toward cover 2 and below the membrane a breathing gas chamber 7 whose pressure corresponds to the internal pressure of the mask. The respiratory gas connection 3 is separated from the breathing chamber 7 by a lung controlled inlet valve 8 for the respiratory gas, containing the valve body 9.

The valve body 9 is movably connected with the control membrane 5 via coupling or rod means 10.

The housing cover 2 contains in a top or outer chamber 6 formed by it, guided in spacers 11, a positive pressure spring 12 which by the pressure against membrane 5 determines the positive pressure in the breathing chamber 7 and hence in the interior of the mask. Cover 2 contains a magnetic key 14 which is axially movable in a guide 13 and is held by an exteriorly mounted return spring 15 in the operating position in contact with a magnet 16. Opposite the magnet 16 is a steel plate 17 carried by the membrane 5.

During normal breathing with the mask applied, the lung controlled valve functions in known manner. Upon inhalation, that is, a negative pressure in the interior of the mask and hence also in the breathing chamber 7, membrane 5 opens the inlet valve 8 via the coupling means 10. During continued breathing, the positive pressure spring 12 controls the positive pressure in the interior of the mask.

Figure 2:
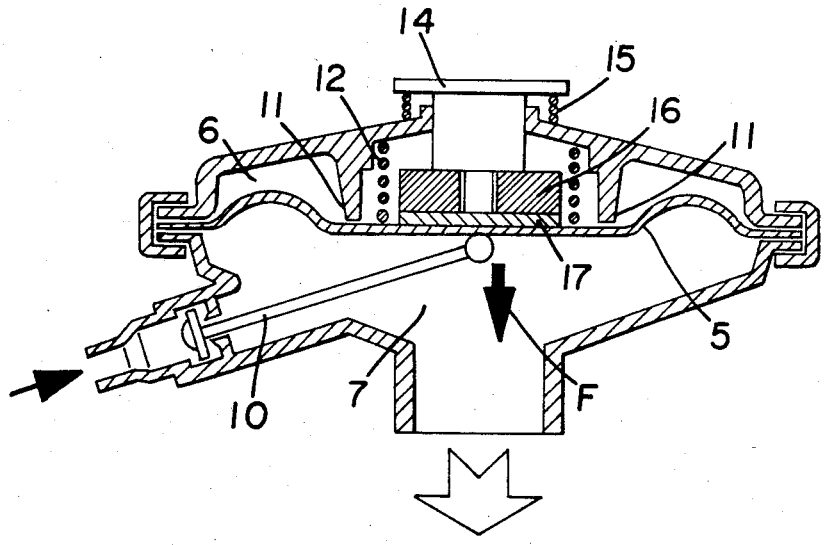
FIG. 2 shows a similar view in shutting state.

To prevent unnecessary outflow of respiratory gas, the inlet valve 8 must be securely closed when the mask is taken off, even when positive pressure in the breathing chamber 7 is then missing. For this purpose the magnetic key 14 is pushed into cover 2 counter to the return spring 15. The magnetic force of magnet 16 attracts the steel plate 17 and hence the membrance 5, holding the latter in the position shown in FIG. 2 counter to the positive pressure spring 12. The inlet valve 8 is closed.

When the mask has been applied and is then ventilated by the user with a first breath, the negative pressure created by the lung in the breathing chamber 7 adds itself to the spring forces of the positive pressure spring 12 and of the return spring 15 with a tensile force F. This force is sufficient to separate the adhesion between the magnet 16 and the steel plate 17. The magnetic key 14 snaps back into operating position, as represented in FIG. 1.

The spacers 11 limit the path of the control membrane 5 when inlet valve 8 is closed, thereby preventing that in the operating position the membrane gets into the region of the magnetic force of magnet 16 unintentionally counter to the force of the positive pressure spring 12.

While specific embodiments of the invention have been shown and described in detail to illustrate the application of the principles of the invention, it will be understood that the invention may be embodied otherwise without departing from such principles.

What is claimed is:

1. A breathing gas control valve for a breathing mask, comprising a housing with an interior chamber, a diaphragm extending across said chamber and dividing said chamber into an outer chamber on one side of said diaphragm and a breathing gas chamber on the other side of said diaphragm, a respiratory gas inlet connected into said breathing gas chamber, a discharge from said breathing gas chamber adapted to be connected to said mask, a valve disposed in said respiratory gas inlet for opening and closing said inlet, coupling means connected between said valve and said diaphragm so as to move said valve for opening and closing said inlet when said diaphragm is moved, a key extending through and movably mounted on said housing and having an outer end and an inner end facing said diaphragm, magnetically attractable elements mounted on said key end and said diaphragm being magnetically attractable and magnetically interengageable, spring means biasing said key and said diaphragm into a separated position, whereby said key is manually movable such that said key end and said diaphragm are engageable together in an attracted position so as to hold said valve closed to stop the flow of respiratory gas, said key and said diaphragm being constructed to generate a magnetic attraction force therebetween of a magnitude such that the attraction force can be overcome by said spring means upon added inhalation effort.

2. A breathing gas control valve for a breathing mask, comprising a housing with an interior chamber, a diaphragm extending across said chamber and dividing said chamber into an outer chamber on one side of said diaphragm and a breathing gas chamber on the other side of said diaphragm, a respiratory gas inlet connected into said breathing gas chamber, a discharge from said breathing gas chamber adapted to be connected to said mask, a valve disposed in said respiratory gas inlet for opening and closing said inlet, coupling means connected between said valve and said diaphragm so as to move said valve for opening and closing said inlet when said diaphragm is moved, a key extending through and movably mounted on said housing and having an outer end and an inner end facing said diaphragm, magnetically attractable elements mounted on said key end and said diaphragm being magnetically attractable and magnetically interengageable, spring means biasing said key and said diaphragm into a separated position, whereby said key is manually movable such that said key end and said diaphragm are engageable together in an attracted position so as to hold said valve closed to stop the flow of respiratory gas, said key and said diaphragm being constructed to generate a magnetic attraction force therebetween of a magnetude such that the attraction force can be overcome by said spring means upon added inhalation effort, said spring means includes a return spring between said key outer end and said housing biasing said key to a disengaged position, said key having an end facing said diaphragm with a magnet, said diaphragm having a steel plate thereon attractable to said magnet, said spring means also including a positive spring disposed between said housing and said diaphragm permitting flexing of said diaphragm as a function of the pressure inside the mask.

3. A respirator mask according to claim 2, wherein said magnet is a permanent magnet.

4. A respirator mask according to claim 2, wherein said housing includes spaced apart parallel spacers on each side of said key extending toward said diaphragm, said positive pressure spring being guided withing said spacers.

5. A respirator mask according to claim 4, wherein said steel plate on said diaphragm is surrounded by material of said diaphragm.

* * * * *